United States Patent [19]

Perfetti et al.

[11] Patent Number: 4,924,888

[45] Date of Patent: May 15, 1990

[54] SMOKING ARTICLE

[75] Inventors: Thomas A. Perfetti, Winston-Salem; Alan B. Norman, Clemmons; Michael F. Dube, Pfafftown, all of N.C.

[73] Assignee: R. J. Reynolds Tobacco Company, Winston-Salem, N.C.

[21] Appl. No.: 51,104

[22] Filed: May 15, 1987

[51] Int. Cl.[5] ..... A24D 1/02

[52] U.S. Cl. ..... 131/336; 131/331; 131/360; 131/364; 131/365

[58] Field of Search ..... 131/336, 365, 331, 360, 131/364

[56] References Cited

U.S. PATENT DOCUMENTS

| | | |
|---|---|---|
| Re. 32,615 | 1/1988 | Luke . |
| 439,004 | 10/1890 | Harris . |
| 2,992,647 | 7/1961 | Figge . |
| 3,046,994 | 7/1962 | Schur . |
| 3,057,360 | 10/1962 | Bugge . |
| 3,280,823 | 10/1966 | Bavley . |
| 3,368,566 | 2/1968 | Avedikian . |
| 3,511,247 | 5/1970 | Tamol . |
| 3,524,451 | 8/1970 | Fredrickson . |
| 3,526,904 | 9/1970 | Tamol . |
| 3,699,973 | 10/1972 | Tamol et al. . |
| 3,705,588 | 12/1972 | Tamol et al. . |
| 3,744,496 | 7/1973 | McCarty et al. . |
| 3,911,932 | 10/1975 | Houck, Jr. et al. . |
| 4,077,414 | 3/1978 | Baker et al. . |
| 4,088,142 | 5/1978 | Horsewell et al. . |
| 4,108,151 | 8/1978 | Martin et al. . |
| 4,129,134 | 12/1978 | Hind et al. . |
| 4,174,719 | 11/1979 | Martin et al. . |
| 4,207,458 | 6/1980 | Lilly, Jr. et al. . |
| 4,225,636 | 9/1980 | Cline et al. . |
| 4,231,377 | 11/1980 | Cline et al. . |
| 4,236,062 | 11/1980 | Lilly, Jr. et al. . |
| 4,407,308 | 10/1983 | Baker et al. . |
| 4,420,002 | 12/1983 | Cline . |
| 4,433,697 | 2/1984 | Cline et al. . |
| 4,450,847 | 5/1984 | Owens . |
| 4,453,553 | 6/1984 | Cohn . |
| 4,461,311 | 7/1984 | Mathews et al. . |
| 4,481,960 | 11/1984 | Brooks . |
| 4,561,454 | 12/1985 | Guess . |
| 4,607,647 | 8/1986 | Dashley et al. . |
| 4,622,983 | 11/1986 | Mathews et al. . |
| 4,624,268 | 11/1986 | Baker et al. . |
| 4,637,410 | 1/1987 | Luke . |
| 4,714,082 | 12/1987 | Banerjee et al. . |
| 4,721,120 | 1/1988 | Greig et al. . |
| 4,805,644 | 2/1989 | Hampl, Jr. et al. . |
| 4,830,028 | 5/1989 | Lawson et al. . |

FOREIGN PATENT DOCUMENTS

| | | |
|---|---|---|
| 568149 | 6/1958 | Belgium . |
| 570440 | 9/1958 | Belgium . |
| 998557 | 1/1952 | France . |

OTHER PUBLICATIONS

*Olin R&D Dept. Report,* McCarty et al. (Aug. 28, 1973).

*Olin R&D Dept. Report,* Rickards et al (Revised: Aug. 25, 1972).

*Tobacco and Tobacco Smoke,* Wynder et al (p. 428, 1967).

*Industrial and Engineering Chemisty,* Leonard (vol. 48, pp. 1331–1341, 1956).

*Tobacco Flavoring for Smoking Products,* Leffingwell et al (p. 13, 1972).

*Beitr. Tabak. Int.,* Yamamoto et al (vol. 12, pp. 259–269, 1984).

*Beitr. Tabak. Int.,* Yamamoto et al (vol. 13, pp. 81–87, 1985).

*Primary Examiner*—V. Millin

[57] ABSTRACT

Cigarettes having low efficiency filters, rods of cut filler having a low packing density, and paper wraps having a high net permeabilities and low inherent permeabilities can yield good taste, low gas phase mainstream deliveries as well as low amounts of visible sidestream smoke. Typical cigarettes have relatively large amounts of volume expanded flue-cured tobacco materials as cut filler, paper wraps containing magnesium oxide and/or magnesium hydroxide, and relatively high levels of air dilution.

45 Claims, 1 Drawing Sheet

SMOKING ARTICLE

BACKGROUND OF THE INVENTION

The present invention relates to smoking articles such as cigarettes, and in particular to cigarettes which generate low amounts of visible sidestream smoke.

Popular smoking articles such as cigarettes have a substantially cylindrical rod shaped structure and include a charge of smokable material such as shredded tobacco (eg., cut filler) surrounded by a paper wrapper thereby forming a so-called "tobacco rod." Certain commercially available cigarettes have cut filler which comprises a major amount or a total amount of flue-cured tobacco material. Often, the use of low nitrogen content cut filler materials is desirable in order to achieve certain smoking characteristics. It has become desirable to manufacture cigarettes having cylindrical filter elements aligned in an end-to-end relationship with the tobacco rod. Typically, filter elements are manufactured from fibrous materials such as cellulose acetate and plug wrap, and are attached to the tobacco rod using a circumscribing tipping material.

Cigarettes are employed by the user by burning one end thereof. The user then receives mainstream smoke into his/her mouth by drawing on the opposite end (eg., the filter end) of the cigarette. During the time that the cigarette is not being drawn upon by the user, it remains burning, and sidestream smoke can be generated. Sidestream smoke is smoke which directly enters the atmosphere during the static burn period of a smoking article. Sidestream smoke diffuses into the atmosphere, and the characteristic visible nature thereof may be perceived negatively by certain individuals.

The so called "full flavor" cigarettes have been popular smoking articles which deliver a desirable tobacco taste, flavor and satisfaction to the smoker. Typically, the "full flavor" cigarettes deliver about 14 mg or more of FTC "tar" per cigarette. Cigarettes also can be classified as "full flavor low tar" cigarettes. Typically, the "full flavor low tar" cigarettes deliver from about 8 to about 14 mg of FTC "tar" per cigarette, as well as lower levels of FTC nicotine as compared to "full flavor" cigarettes. Yet another classification of popular cigarettes is the "ultra low tar" cigarette which delivers still lower levels of FTC "tar" and nicotine. Typically, the "ultra low tar" cigarettes deliver less than about 7 mg of FTC "tar" per cigarette. The "full flavor low tar" and "ultra low tar" cigarettes conventionally have air dilution means such as laser perforations provided in the periphery of the mouthend region thereof, or have filter elements highly efficient for the removal of "tar" and nicotine from the mainstream aerosol. In general, the perceived taste or strength of the cigarettes classified as having lower levels of "tar" and nicotine are progressively less than that of the cigarettes which are classified as approaching the characteristics of the "full flavor" cigarettes.

Recently, consumers of cigarettes have tended to demand an increased selection of various "full flavor low tar" and "ultra low tar" cigarettes. Such cigarettes have flavor patterns which are milder than those flavor patterns characteristic of either "full flavor" cigarettes or cigarettes which were marketed in the past. However, the presently popular lower "tar" cigarettes have achieved consumer acceptance because the taste and smoking satisfaction provided by such cigarettes have remained high. In addition, certain consumers have indicated a desire to decrease the levels of visible sidestream smoke generated by their cigarettes.

U.S. Pat. No. 4,637,410 to Luke proposes a cigarette having a circumference of from 10 mm to 19 mm. At col. 2, lines 5–7 of the reference, it is disclosed that the proposed cigarettes exhibit lower smoke component mainstream and sidestream deliveries.

U.S. Pat. No. 4,624,268 to Baker et al proposes a cigarette having wrapper paper with an inherent air permeability of 3 to 45 CORESTA. For example, the wrapper paper is disclosed as having a coating of starch, aluminum oxide, magnesium oxide, calcium oxide, sodium formate and sodium acetate. See col. 3, lines 23–37. However, such a cigarette would be expected to yield mainstream smoke having a relatively high gas phase content.

Certain references suggest that certain gases can be removed from the mainstream smoke of cigarettes. For example, Avedikian in U.S. Pat. No. 3,368,566 proposes a cigarette having a plurality of short filters which individually contain certain substances for the supposed removal of various substances from mainstream cigarette smoke. Another cigarette having a less complicated filter design than that design proposed by Avedikian is proposed by Brooks in U.S. Pat. No. 4,481,960. Although Brooks proposes a cigarette having (i) a paper wrap with the possibility of a wide range of air permeability, and (ii) air dilution such that the yield of mainstream carbon monoxide is relatively low, the reference does not address a cigarette yielding a low level of visible sidestream smoke.

U.S. Pat. No. 4,231,377 to Cline et al, U.S. Pat. No. 4,420,002 to Cline, and U.S. Pat. No. 4,450,847 to Owens propose that cigarette paper wrappers containing magnesium oxide and/or magnesium hydroxide materials can be used in order to manufacture cigarettes which yield reduced visible sidestream smoke during static burn periods. However, such low permeability paper wrappers can tend to provide an off-taste to mainstream smoke or an undesirable aroma to sidestream smoke.

It would be desirable for the cigarette manufacturer to provide a good tasting cigarette which meets the desires and demands of certain smokers or groups of smokers. In particular, it would be desirable to provide a good tasting cigarette which delivers the characteristic mild taste of low "tar" cigarettes, provides good smoking satisfaction, provides low mainstream gas phase deliveries, and which generates low levels of visible sidestream smoke.

SUMMARY OF THE INVENTION

The present invention relates to a smoking article which delivers good tobacco taste and satisfaction. Such cigarettes also are capable of delivering relatively low levels of FTC "tar" in combination with relatively low levels of carbon monoxide and other gaseous components. In addition, such cigarettes generate relatively low levels of visible sidestream smoke.

Cigarettes of this invention include a rod of filler material contained in a circumscribing wrapping material. The majority of the filler material preferably is flue-cured tobacco of some form, and the filler material has a low packing density within the rod. The wrapping material is highly permeable and has a relatively slow burn rate. In particular, the wrapping material has a relatively low inherent permeability and a relatively high net permeability. Preferably, the wrapping material includes at least one inorganic oxide and/or inorganic hydroxide contained therein. The cigarette also includes a low efficiency filter means at one end thereof, and preferably a means for providing air dilution thereto. Alternatively, the cigarette has a mouthpiece equipped with means for providing air dilution to the cigarette.

The wrapping material is perforated enough to provide a cigarette which can deliver good tasting mainstream aerosol. However, the level of perforation is not so great that the air dilution provided thereby lowers the delivered taste to an undesirably low level. The slow burning nature of the wrapping material is typically such that a cigarette manufactured therewith burns at a rate such that the cigarette yields from 1 to 2 more puffs under FTC smoking conditions than a cigarette of comparable dimensions, configuration, smokable filler material and FTC "tar" delivery similarly manufactured using a conventional cigarette paper wrap. Examples of conventional cigarette paper wraps are manufactured from flax fiber and calcium carbonate filler, have wrapper permeabilities between 20 and 120 cm/min and basis weights of 20 to 30 g/m$^2$. See, Durocher, *Rec. Adv. Tob. Sci.*, Vol. 10, pp.52–71 (1984) and Samfield, *Tob. Jour. Int'l.*, 5/82, pp. 390–394 (1982).

DETAILED DESCRIPTION OF THE PREFERRED EMBODIMENTS

Figure 1:
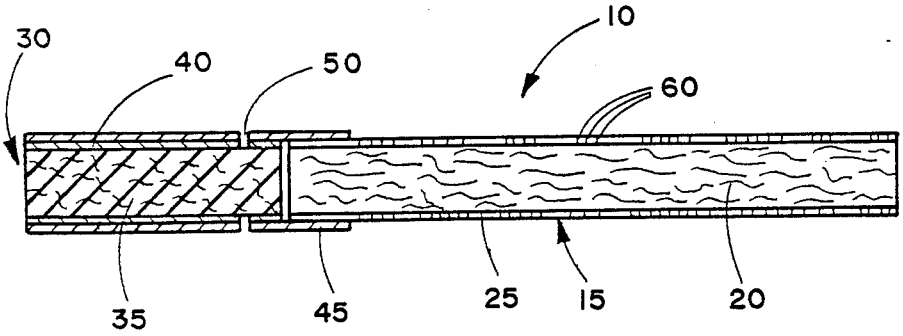
FIG. 1 is a longitudinal sectional view of an embodiment of this invention.

One embodiment of a smoking article of this invention is shown in FIG. 1 and has the form of a cigarette 10. The cigarette includes a generally cylindrical rod 15 of filler material 20 contained in circumscribing wrapping material 25. The rod 15 is conveniently referred to as a "smokable rod" or a "tobacco rod." The ends of the tobacco rod are open to expose the filler material.

The cigarette 10 also includes a filter element 30 or other suitable mouthpiece positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinally extending surface thereof with circumscribing plug wrap material 40.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 40 and the outer surface of the wrapping material 25 of the tobacco rod, using a suitable adhesive. A ventilated or air diluted smoking article is provided with an air dilution means such as a series of perforations 50 each of which extend through the tipping material and plug wrap.

Figure 2:
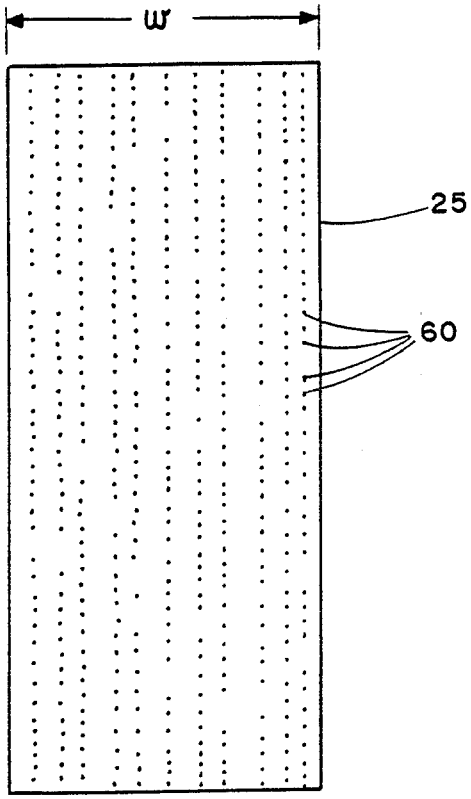
FIG. 2 is a diagrammatic illustration of the type of wrapping material which can be employed to provide the smokable rod of the article of this invention.

Referring to FIGS. 1 and 2, the wrapping material 25 has a width w (shown in FIG. 2) which is equal to the circumference of the cigarette plus the lap zone of the glue line which ultimately results during cigarette manufacture. The wrapping material 25 includes a series of perforations 60 which extend in a linear fashion along the longitudinal length of thereof. Alternatively, other configurations such as a random perforation pattern can be provided. The size, number and relative positioning of the individual perforations 60 can vary depending upon the desired characteristics of the cigarette which has the wrapping material incorporated therein. The individual perforations are shown as enlarged in FIGS. 1 and 2.

Typically, the tobacco rod has a length which ranges from about 50 mm to about 85 mm, and a circumference of about 16 mm to about 28 mm. The tobacco rods and the resulting cigarettes can be manufactured in any known configuration using known cigarette making techniques and equipment.

Typically, the filter element has a length which ranges from about 20 mm to about 35 mm and a circumference of about 16 mm to about 28 mm. The filter material can be any suitable material such as cellulose acetate, polypropylene, tobacco material, or the like. The plug wrap typically is a conventional paper plug wrap, and can be either air permeable or essentially air impermeable. However, if desired, a nonwrapped cellulose acetate filter element can be employed. The various filter elements suitable for use in this invention can be manufactured using known cigarette filter making techniques and equipment.

Filter elements preferably provide minimal mainstream smoke removal efficiencies while maintaining the desirable draw characteristics of the cigarette. Such minimal smoke removal efficiencies are provided by the so-called "low efficiency" filters. Low efficiency filters have a minimal ability to remove mainstream smoke particulates. Generally, low efficiency filters provide about 40 weight percent mainstream smoke particulate removal efficiency or less. The low efficiency filter is desirably used herein in order that the relatively low "tar" yield is obtained primarily as a result of a relatively high level of filter ventilation or air dilution. Such cigarette configurations provide a means for reducing the yields of mainstream gaseous components. An example of a suitable material for providing a low efficiency filter element is a cellulose acetate tow item having about 8 denier per filament and about 40,000 total denier.

Alternatively, the cigarette can have a mouthpiece equipped with means for providing air dilution to the mainstream aerosol. The mouthpiece can be a simple hollow tube of paper or plastic (eg., polyethylene, or the like) to which the air dilution can be provided by the addition of holes, slits, or the like. Such a mouthpiece can provide high levels of air dilution to the mainstream aerosol without filtration of the smoke by a filter material such as cellulose acetate.

The filler material employed in the manufacture of the smokable rod can vary in order to give a smokable rod of relatively low packing density. Normally, the majority of the filler material present in the smokable rod is flue-cured tobacco material of some form. The flue-cured tobacco material can be blended with other tobacco materials, such as the Oriental tobaccos; as well as tobacco substitute materials. For example, puffed grains such as puffed milos, rye, barley, and the like, also can be employed as filler materials. Often, certain amounts of Burley or Maryland tobaccos, or the so called rare or specialty tobaccos can be employed as blend components also. The tobacco materials can be employed in a processed form (eg., as volume expanded flue-cured tobacco filler). For example, the tobacco material can be volume expanded using the techniques described in U.S. Pat. No. 3,524,451 to Fredrickson or in U.S. Pat. No. 4,531,529 to White et al. If desired the preferred flue-cured tobacco material can be blended with processed tobacco stems, reconstituted tobacco materials (eg., preferably those reconstituted tobacco materials made principally from flue-cured tobacco and/or Oriental tobaccos), or tobacco substitute materials. If desired, the preferred tobacco materials can be blended with varying amounts of carbonized and/or pyrolyzed materials.

The smokable materials generally are employed in the form of cut filler as is common in conventional cigarette manufacture. For example, the smokable filler material can be employed in the form of shreds or strands cut into widths ranging from about 1/25 inch to about 1/60 inch, preferably from about 1/30 inch to about 1/40 inch. Generally, such pieces have lengths which range from about 0.25 inch to about 3 inches. The filler material most desirably is composed of more than about 70 weight percent flue-cured tobacco material, more preferably more than about 75 weight percent flue-cured tobacco material, and most preferably more than about 80 weight percent flue-cured tobacco material. Oftentimes in instances when the flue-cured tobacco cut filler is highly volume expanded, a majority of the volume of the filler material within a blend is occupied by the volume expanded flue-cured tobacco material (eg., more than about 80 percent, and frequently more than 90 percent of the volume of the filler is occupied by the flue-cured tobacco material).

An example of a preferred filler material includes about 10 to about 20 percent by weight of Oriental tobacco material and from about 80 to about 90 percent by weight of flue-cured tobacco material.

Preferred filler materials include a relatively large proportion of volume expanded flue-cured tobacco material. Such volume expanded tobacco materials aid in providing a tobacco rod having a low packing density. An example of a suitable blend is a blend of about 17 weight percent Oriental tobaccos and about 83 weight percent volume expanded flue-cured tobacco. As used herein, "packing density" means the weight of the filler material which occupies a unit volume within the smokable rod. For articles of this invention, the packing density generally ranges from about 100 $mg/cm^3$ to about 250 $mg/cm^3$, more typically from about 100 $mg/cm^3$ to about 200 $mg/cm^3$, and in certain instances from about 130 $mg/cm^3$ to about 180 $mg/cm^3$.

Flavorants can be incorporated into the cigarettes. For example, the filler materials can be employed with or without casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives such as organic acids can be incorporated into the cigarette as additives to the cut filler. In particular, levulinic acid, nicotine levulinate, or a mixture of levulinic acid and nicotine can be incorporated into the cigarette. For example, the levulinic acid, nicotine levulinate or levulinic acid/nicotine mixture can be added to the cut filler in amounts which typically range from about 1 to about 10 percent, based on the weight of the cut filler.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (eg., by mechanical or laser perforation techniques) so as to have a region of perforations, openings or vents thereby providing a means for providing air dilution to the cigarette. The total surface area of the perforations and the positioning of the perforations along the periphery of the smoking article can be varied in order to control the performance characteristics of the smoking article.

Preferably, the air dilution means is positioned along the length of the cigarette at a point along the filter which is at a maximum distance from the extreme mouthend of the article. The maximum distance is dictated by factors such as manufacturing constraints associated with the type of tipping employed and the cigarette manufacturing apparatus and process. For example, for a filter element having a 27 mm length, the maximum distance may range from about 23 mm to about 26 mm from the extreme mouthend of the filter element. The positioning of the air dilution vents a maximum distance from the extreme mouthend of the article allows for providing a maximum ventilation level for a given "tar" yield and maximum cigarette pressure drop for a given filter element and tobacco rod combination.

As used herein, the term "air dilution" is the ratio (generally expressed as a percentage) of the volume of air drawn through the air dilution means to the total volume of air and aerosol drawn through the smoking article and exiting the extreme mouthend portion of the smoking article. For air diluted or ventilated smoking articles of this invention, the amount of air dilution can vary. Generally, the amount of air dilution for a cigarette is greater than about 30 percent, preferably greater than about 40 percent, more preferably greater than about 50 percent. Typically, for cigarettes of relatively small circumference (i.e., about 21 mm or less) the air dilution can be somewhat less than that of cigarettes of larger circumference. The upper limit of air dilution for a cigarette typically is less than about 85 percent, more frequently less than about 75 percent.

As used herein, the term "pressure drop" in referring to the smoking article is meant that difference between atmospheric pressure at the extreme mouthend point of the smoking article, as measured at a given flow rate through the smoking article. Typical pressure drop values for cigarettes of this invention are greater that about 40 mm, more frequently greater than about 50 mm of water pressure drop at 17.5 ml/sec of air flow rate.

Most desirable wrapping materials for the tobacco rod have relatively low inherent permeabilities and relatively high net permeabilities. By the term "inherent permeability" is meant the air flow porosity of the wrapping material itself. Typically, wrapping materials having low inherent permeabilities have porosities which are less than about 45 CORESTA units, preferably less than about 30 CORESTA units and more preferably about 15 CORESTA units or less. By the term "net permeability" is meant the air flow porosity of the wrapping material as used in manufacturing the tobacco rod. Typically, the air permeability is provided to the wrapping material using micro laser, mechanical or electrostatic perforation techniques. During micro laser and electrostatic perforation operations, it is most desirable that care be taken to maintain the desired color and opacity of the paper. For example, it is most desirable to minimize or avoid an unsightly "browning" or singeing of the paper.

Preferred wrapping materials are paper wrapping materials which contain from about 10 to about 45 percent by weight of magnesium oxide and/or magnesium hydroxide, as well as flax, cellulose pulp, burn additives such as potassium citrate or potassium carbonate, and other materials such as fillers. Often, desirable paper wrapping materials contain more than about 15 percent by weight of magnesium oxide and/or magnesium hydroxide. Examples of suitable materials are described in U.S. Pat. No. 4,231,377 to Cline et al; U.S. Pat. No. 4,420,002 to Cline and U.S. Pat. No. 4,450,847 to Owens.

The wrapping materials are processed in order to have a relatively high net permeabilities. For example, wrapping materials having low inherent permeabilities can be perforated using conventional electrostatic perforating techniques (eg., to provide individual perforations comparable in size to conventional electrostatically provided perforations) to obtain a wrapping material having a porosity of from about 50 to about 250 CORESTA units, preferably from about 80 to about 140 CORESTA units, more preferably from about 90 to about 120 CORESTA units.

The sizes of the individual perforations which provide for the high net permeabilities to the cigarette paper wrap generally are such that the perforations are larger than the pores which are present in the naturally occurring paper wrap (i.e., which provide the inherent permeability to the paper). For aesthetics purposes, the individual perforations preferably are small enough to not be unsightly. For example, the perforations are not particularly noticable, and in most instances are barely visible to the naked eye.

Cigarettes of this invention generally deliver FTC "tar" in the range from about 2 to about 10 mg/ cigarette; and carbon monoxide in the range lower than that of a cigarette of a comparable "tar" level. The cigarettes yield relatively low levels of mainstream gaseous components such as carbon monoxide and nitrogen oxides. For example, typical FTC "tar" to FTC carbon monoxide ratios are less than about 1, frequently less than about 0.8, in certain instances less than about 0.6.

Cigarettes of this invention generally deliver less smoke due to the relatively low total consumable tobacco weight provided by the expanded tobaccos, grains and/or carbonized materials. By the term "less smoke" in referring to a cigarette of this invention is the weight loss during FTC smoking conditions is lower than conventional cigarettes of similar "tar" delivery and configuration. Weight loss is measured by collecting the ash and butt of the cigarette after smoking, and comparing that weight to the total weight of the cigarette before smoking. Total weight loss of a cigarette during smoking is directly related to the total smoke emitted by the cigarette. Cigarettes of this invention exhibit a weight loss which is typically about 15 percent less, and occasionally as much as about 25 percent less than conventional cigarettes of comparable FTC "tar" delivery and configuration.

Cigarettes of this invention produce less visible sidestream smoke than conventional cigarettes of comparable configuration when evaluated using the method described by Baker at col. 3, lines 38–49 of U.S. Pat. No. 4,624,268. The reduction in visible sidestream smoke of cigarettes of this invention is such that sidestream smoke emitted by cigarettes of this invention frequently can be as much as 50 percent of that of conventional cigarettes of comparable FTC "tar" delivery and configuration. By the term "configuration" in referring to a cigarette is meant the circumference, tobacco rod length and filter element length. In addition, in terms of sensory perception, the sidestream smoke of cigarettes of this invention can be characterized as less irritating than that of conventional cigarettes of comparable FTC "tar" delivery and configuration when evaluated using the test methodology described by G. A. Ryan, 40 *th Tobacco Chemists'Research Conference* (Oct., 1986).

The following examples are provided in order to further illustrate the invention but should not be construed as limiting the scope thereof. Unless otherwise noted, all parts and percentages are by weight.

EXAMPLE 1

Cigarettes having lengths of about 99 mm and circumferences of about 24.85 mm have tobacco rod lengths of 68 mm and filter element lengths of 31 mm. The tobacco rod includes a charge of tobacco cut filler contained in a circumscribing cigarette paper wrap. The filler material employed in providing the tobacco rod is in the form of strands cut at about 32 cuts per inch. The initial filler material includes a blend of about 83 percent flue-cured tobacco which has been volume expanded to about twice its original volume, and about 17 percent Oriental tobacco. The blend has a water and glycerine casing applied thereto.

The paper wrap is sold commercially as Ecusta Experimental No. TOD 03363 by Ecusta Corp. The paper wrap is a heavy weight sheet, low visible sidestream paper, and contains about 25 percent magnesium hydroxide and 15 percent calcium carbonate. The paper has an inherent permeability of 15 CORESTA units and a basis weight of 45 g/m2 The paper is electrostatically perforated in order to yield a net permeability of 110 CORESTA units. The general perforation pattern is shown in FIG. 2. The individual perforations each have a size comparable to conventional electrostatic perforations in conventional cigarette wrap, and are positioned with about 1 to about 10 perforations/mm essentially linearly in the longitudinal direction such that the lines of perforations are positioned about 1 mm to about 3 mm apart.

The low efficiency filter element is manufactured using conventional cigarette filter making technology from cellulose acetate tow (8 denier per filament, 40,000 total denier) and circumscribing air permeable paper plug wrap having a porosity of 26,000 cm/min.

The tobacco rod and filter element have similar circumferences, are aligned in an abutting, end-to-end relationship, and are secured together using tipping paper having a porosity of 3,000 ml/min. The tipping paper is adhesively secured to the filter element and the adjacent portion of the tobacco rod. The tipping material circumscribes the length of the filter element and about 3 mm of the length of the tobacco rod. Cigarettes so described are manufactured using a Hauni Protos Cigarette Maker from Hauni-Werke Korber & Co. KG. A ring of mechanically provided perforations thus providing the permeability extends around the periphery of the cigarette about 26 mm from the extreme mouthend thereof. The perforations so provided yield cigarettes with about 53 percent air dilution.

The cigarette weighs 0.8904 g and the filler material within the rod has a packing density of 155 mg/cm$^3$. The cigarette is smoked under FTC conditions. The cigarette yields 7.3 mg FTC "tar", 0.72 mg nicotine, 6.4 mg carbon monoxide, 37 micrograms nitrogen oxides, and a puff count of 9.8.

The cigarette is smoked and delivers a rich tobacco flavor as well as an acceptable draft resistance. The mainstream aerosol is not harsh and the cigarette yields desirable smoking satisfaction. Also, the cigarette yields low amounts of visible sidestream smoke.

EXAMPLE 2

The cigarettes are provided using the procedure and materials described in Example 1, except that the tipping paper has a porosity of 7,000 ml/min thereby providing cigarettes which are 74 percent air diluted.

A cigarette weighs 0.8848 g is smoked under FTC conditions and yields 4.3 mg FTC "tar", 0.48 nicotine, 3.3 mg carbon monoxide, 21 micrograms nitrogen oxides, and a puff count of 10.6.

The cigarette is smoked and delivers a rich tobacco flavor as well as an acceptable draft resistance. The mainstream aerosol is not harsh and the cigarette yields desirable smoking satisfaction. Also, the cigarette yields low amounts of visible sidestream smoke.

EXAMPLE 3

Cigarettes are provided using the following procedure.

Cigarettes having lengths of about 84 mm and circumferences of about 24.85 mm have tobacco rod lengths of 57 mm and filter element lengths of 27 mm. The tobacco rod includes a charge of tobacco cut filler described in Example 1 contained in a circumscribing cigarette paper wrap which is described in Example 1. The filler material has a nicotine content of 2.1 percent. The low efficiency filter element is manufactured using conventional cigarette filter making technology from cellulose acetate tow (8 denier per filament, 40,000 total denier) and circumscribing air permeable paper plug wrap having a CORESTA porosity of 26,000 cm/min. The tobacco rod and filter element are aligned in an abutting, end-to-end relationship and secured together using nonporous tipping paper. The tipping paper is adhesively secured to the filter element and the adjacent portion of the tobacco rod. The tipping material circumscribes the length of the filter element and about 3 mm of the length of the tobacco rod. Cigarettes so described are manufactured using a Hauni Protos Cigarette Maker from Hauni-Werke Korber & Co. KG. A ring of laser perforations thus providing the permeability is provided using a Hauni Lab Laser. The perforations extend around the periphery of the cigarette about 22 mm from the extreme mouthend thereof. The perforations so provided yield 0 cigarettes which are about 73 percent air diluted.

The cigarette which weighs 0.7180 g and the packing density of the filler material within the rod is 152 mg/cm$^3$. The cigarette is smoked under FTC conditions yields 4.1 mg FTC "tar", 0.44 mg nicotine, 2.8 mg carbon monoxide, 15 micrograms nitrogen oxides, and a puff count of 8.1.

The cigarette is smoked and delivers a rich tobacco flavor as well as an acceptable draft resistance. The mainstream aerosol is not harsh and the cigarette yields desirable smoking satisfaction. Also, the cigarette yields low amounts of visible sidestream smoke.

The cigarette is evaluated using the sensory test methodology described by Ryan, supra, and yields less perceptual sidestream irritation than a conventional cigarette of comparable FTC "tar" delivery and configuration.

The cigarette is evaluated for sidestream nicotine and wet total particulate matter (WTPM) using techniques as described by Baker et al in U.S. Pat. No. 4,624,268. The cigarette yields 1.97 mg sidestream nicotine and 7.60 mg sidestream WTPM. The cigarette is evaluated for respirable suspended particulate matter (RSP) using a TSI Model 5000 automatic respirable aerosol mass monitor and techniques described by Heavner et al at the 39 *th Tobacco Chemists'Research Conference* (1985). The cigarette yields 93.1 micrograms/m$^3$ RSP.

For comparison purposes a cigarette designated as Reference Cigarette 1R4F is obtained from Tobacco and Health Research Institute, Lexington, Ky. The cigarette weights 1.019 g, has a length of 83 mm, a circumference of 25 mm, a smokable rod length of 56 mm, and a filter element length of 27 mm. The cigarette is provided with 28 percent air dilution by mechanical perforation means. The cigarette has a blend of about 35 percent flue-cured tobacco, about 22 percent Burley tobacco, about 12 percent Oriental tobacco, about 1 percent Maryland tobacco, about 30 percent processed tobacco sheet and about 8 percent casing materials. The nicotine content of the blend is 2.1 percent. The packing density of the tobacco within the rod is 268 mg/cm$^3$.

The comparative cigarette is smoked under FTC conditions, and yields 9.2 mg FTC "tar", 11.6 mg CO, 0.8 mg nicotine, 340 micrograms nitrogen oxides, and a puff count of 9.2. The cigarette is evaluated for sidestream nicotine, WTPM and RSP, as described hereinbefore. The cigarette yields 5.32 mg sidestream nicotine, 25.3 mg WTPM and 408 micrograms/m$^3$ RSP.

EXAMPLE 4

Cigarettes having lengths of about 84 mm and circumferences of about 20 mm have tobacco rod lengths of 59 mm and filter element lengths of 25 mm. The tobacco rod includes a charge of tobacco cut filler, and a circumscribing cigarette paper wrap which is sold commercially as Ecusta Experimental No. TOD 01788 by Ecusta Corp. The paper wrap is a heavy weight sheet, low visible sidestream paper and contains about 12 percent magnesium hydroxide and about 28 percent calcium carbonate. The paper has an inherent permeability of 15 CORESTA units and a basis weight of 45 g/m$^2$. The paper is electrostatically perforated as generally described in Example 1 in order to yield a net permeability of 110 CORESTA units.

The filler material employed in providing the tobacco rod is in the form of strands or shreds of tobacco cut at about 32 cuts per inch. The filler material includes a blend of about 87 percent flue-cured tobacco which has been volume expanded to about twice its original volume, and about 13 percent Oriental tobacco. The blend has a water and glycerin casing applied thereto. The nicotine content of the blend is about 2.3 percent.

The low efficiency filter element is manufactured from cellulose acetate tow (8 denier per filament, 35,000 total denier) and circumscribing air impermeable paper plug wrap. The total rod and filter element are secured together using nonporous tipping paper. The tipping paper is adhesively secured to the filter element and an adjacent portion of the tobacco rod. Cigarettes so described are manufactured using a Hauni Protos Cigarette Maker. A ring of laser perforations thus providing the permeability is provided using a Hauni Lab Laser. The perforations extend around the periphery of the cigarette about 23 mm from the extreme mouthend thereof. The perforations so provided yield cigarettes with about 63 percent air dilution.

The cigarette weights 0.540 g and the filler material within the rod has a packing density of 0.163 g/cm3 The cigarette burns at a static burn rate of 52 mg/min or 8.1 mm/min. The cigarette is smoked under FTC smoking conditions and yields 4.0 mg FTC "tar", 3.7 mg carbon monoxide, 0.34 mg nicotine, 17.3 micrograms nitrogen oxides, and a puff count of 5.9.

The cigarette is smoked and delivers a rich tobacco flavor as well as an acceptable draft resistance. The mainstream aerosol is not harsh and the cigarette yields desirable smoking satisfaction. Also, the cigarette yields low amounts of visible sidestream smoke.

EXAMPLE 5

Cigarettes having lengths of about 84 mm and circumferences of about 24.8 mm have tobacco rod lengths of 60 mm and filter element lengths of 25 mm. The tobacco rod includes a change of tobacco cut filler, and a circumscribing cigarette paper wrap which is sold commercially as Ecusta Experimental No. TOD 1788 by Ecusta Corp. The paper wrap is a heavy weight sheet, low visible sidestream paper and contains about 2 percent magnesium hydroxide and about 28 percent calcium carbonate. The paper has an inherent permeability of 15 CORESTA and a basis weight of 45 g/m$^2$. The paper is electrostatically perforated as generally described in Example 1 in order to yield a net permeability of 110 CORESTA units.

The filler material employed in providing the tobacco rod is in the form of strands or shreds of tobacco cut at about 32 cuts per inch. The filler material includes a blend of about 87 percent flue-cured tobacco which has been volume expanded to about twice its original volume, and about 13 percent Oriental tobacco. The blend has a water and glycerin casing applied thereto. The nicotine content of the blend is about 2.1 percent.

The low efficiency filter element is manufactured from cellulose acetate tow (8 denier per filament, 40,000 total denier) and circumscribing air impermeable paper plug wrap. The total rod and filter element are secured together using nonporous tipping paper. The tipping paper is adhesively secured to the filter element and an adjacent portion of the tobacco rod. Cigarettes so described are manufactured using a Hauni Protos Cigarette Maker. A ring of laser perforations thus providing the permeability is provided using a Hauni Lab Laser. The perforations extend around the periphery of the cigarette about 23 mm from the extreme mouthend thereof. The perforations so provided yield cigarettes with about 71 percent air dilution.

The cigarette weights 0.740 g and the filler material within the rod has a packing density of 0.123 g /cm$^3$. The cigarette burns at a static burn rate of 60 mg/min or 6.5 mm/min. The cigarette is smoked under FTC smoking conditions and yields 5.2 mg FTC "tar", 2.9 mg carbon monoxide, 0.53 mg nicotine, 14.3 micrograms nitrogen oxides, and a puff count of 6.6.

The cigarette is smoked and delivers a rich tobacco flavor as well as an acceptable draft resistance. The mainstream aerosol is not harsh and the cigarette yields desirable smoking satisfaction. Also, the cigarette yields low amounts of visible sidestream smoke.

What is claimed is:

1. A cigarette comprising:

(a) a rod of smokable material contained in a circumscribing wrapping material, wherein (i) a majority by weight of the smokable material is flue-cured tobacco material;

(ii) the wrapping material is a paper wrap containing inorganic oxide and/or inorganic hydroxide, has an inherent permeability of less than about 30 CORESTA units, and has a net permeability between about 80 CORESTA units and about 140 CORESTA units; and (iii) the packing density of the smokable material within the rod is between about 100 mg/cm$^3$ and about 200 mg/cm$^3$;

(b) mouthend piece in the form of a filter element which is capable of providing about 40 weight percent or less mainstream tobacco smoke particulate removal efficiency axially aligned with one end of the rod; and (c) means for providing greater than about 30 percent air dilution to the cigarette.

2. The cigarette of claim 1 wherein the wrapping material is a paper wrap containing magnesium oxide and/or magnesium hydroxide.

3. The cigarette of claim 1 wherein the ratio of FTC carbon monoxide to FTC "tar" thereof is less than 1.

4. The cigarette of claim 1 wherein the ratio of FTC carbon monoxide to FTC "tar" thereof is less than 0.8.

5. The cigarette of claim 1 or 2 wherein the flue-cured tobacco material is volume expanded flue-cured tobacco cut filler.

6. The cigarette of claim 1 or 2 having a length from about 84 mm to about 120 mm, a filter element having a length of about 20 mm to about 35 mm, and the air dilution means which includes a series of perforations positioned in a region along the filter element from about 19 to about 34 mm from the extreme mouthend of the cigarette.

7. The cigarette of claim 1 or 2 wherein the smokable material also includes a blend of Oriental tobaccos.

8. The cigarette of claim 3 wherein the paper wrap has a basis weight of about 20 g/m$^2$ to about 50 g/m$^2$; and the magnesium oxide and/or magnesium hydroxide contained therein ranges from about 10 to about 45 weight percent.

9. The cigarette of claim 1 or 2 which delivers an FTC "tar" delivery of from about 2 mg to about 10 mg.

10. The cigarette of claim 1 or 2 wherein the smokable material is absent of Burley tobacco.

11. The cigarette of claim 1 or 2 wherein the smokable material is absent of Maryland tobacco.

12. The cigarette of claim 1 or 2 wherein more than about 80 weight percent of the smokable material is flue-cured tobacco material.

13. A cigarette of claim 1 or 2 having a circumference of from about 16 mm to about 28 mm.

14. A cigarette of claim 1 or 2 having a circumference of from about 19 mm to about 22 mm.

15. The cigarette of claim 1 or 2 wherein the wrapping material is electrostatically perforated so as to have a net permeability greater than about 80 CORESTA units.

16. The cigarette of claim 1 or 2 wherein the wrapping material is a paper wrap containing greater than about 15 percent by weight magnesium oxide.

17. The cigarette of claim 1 or 2 wherein the smokable material includes from about 10 to about 20 percent by weight of Oriental tobacco material, and from about 80 to about 90 percent by weight of flue-cured tobacco material.

18. The cigarette of claim 1 or 2 further comprising methanol flavorant.

19. A cigarette comprising:

(a) a rod of smokable material contained in a circumscribing wrapping material, wherein
  (i) a majority by weight of the smokable material is flue-cured tobacco material;
  (ii) the wrapping material is a paper wrap containing magnesium oxide and/or magnesium hydroxide, has an inherent permeability of less than 45 CORESTA units, and has a net permeability between about 80 CORESTA units and about 140 CORESTA units; and
  (iii) the packing density of the smokable material is between about 100 mg/cm$^3$ and about 200 mg/cm$^3$; and
(b) mouthend piece in the form of a filter element which is capable of providing about 40 weight percent or less mainstream tobacco smoke particulate removal efficiency axially aligned with one end of the rod; and
(c) means for providing greater than about 30 percent air dilution to the cigarette.

20. The cigarette of claim 19 wherein the paper wrap contains magnesium oxide and/or magnesium hydroxide at an amount greater than about 15 percent, based on the total weight of the wrap.

21. The cigarette of claim 19 further comprising methanol flavorant.

22. The cigarette of claim 19 comprising means for providing greater than about 50 percent air dilution thereto, and wherein a majority of the volume of the smokable material is volume expanded flue-cured tobacco material.

23. The cigarette of claim 19 having a length of about 120 mm or less.

24. A cigarette comprising:

(a) a rod of smokable material contained in a circumscribing wrapping material, wherein
  (i) at least about 70 percent by weight of the smokable material is flue-cured tobacco material;
  (ii) the wrapping material is a paper wrap containing magnesium oxide and/or magnesium hydroxide, has an inherent permeability of less than about 45 CORESTA units, and has a net permeability between about 80 CORESTA units and about 140 CORESTA units; and
  (iii) the packing density of the smokable material within the rod is between about 100 mg/cm$^3$ and about 200 mg/cm$^3$;
(b) mouthend piece axially aligned with one end of the rod; and
(c) means for providing air dilution to the cigarette, wherein the ratio of FTC carbon monoxide to FTC "tar" of the cigarette is less than 0.8.

25. The cigarette of claim 24 wherein the mouthend piece is a filter element.

26. A cigarette comprising:

(a) a rod of smokable material contained in a circumscribing wrapping material, wherein
  (i) at least about 70 percent by weight of the smokable material is flue-cured tobacco material;
  (ii) the wrapping material is a paper wrap containing inorganic oxide and/or inorganic hydroxide, has an inherent permeability of less than about 45 CORESTA units, and has a net permeability of greater than 50 CORESTA units; and
  (iii) the packing density of the smokable material within the rod is between about 100 mg/cm$^3$ and about 250 mg/cm$^3$;
(b) mouthend piece axially aligned with one end of the rod; and
(c) means for providing greater than about 30 percent air dilution to the cigarette; the cigarette further comprising
(d) nicotine levulinate as an additive thereto.

27. A cigarette comprising:

(a) a rod of smokable material contained in a circumscribing wrapping material, wherein
  (i) at least about 70 percent by weight of the smokable material is flue-cured tobacco material;
  (ii) the wrapping material is a paper wrap containing inorganic oxide and/or inorganic hydroxide, has an inherent permeability of less than about 45 CORESTA units, and has a net permeability of greater than 50 CORESTA units; and
  (iii) the packing density of the smokable material within the rod is between about 100 mg/cm$^3$ and about 250 mg/cm$^3$;
(b) mouthend piece axially aligned with one end of the rod; and
(c) means for providing greater than about 30 percent air dilution to the cigarette; the cigarette further comprising
(d) levulinic acid as an additive thereto.

28. The cigarette of claim 27 further comprising nicotine as an additive thereto.

29. The cigarette of claim 26, 27 or 28 wherein the wrapping material is a paper wrap containing magnesium oxide and/or magnesium hydroxide.

30. A cigarette comprising:

(a) a rod of smokable material contained in a circumscribing wrapping material, wherein
  (i) the wrapping material is a paper wrap having an inherent permeability of less than 15 CORESTA units and a net permeability of greater than about 80 CORESTA units; and
  (ii) the packing density of the smokable material is between about 100 mg/cm$^3$ and about 250 mg/cm$^3$; and
(b) mouthend piece axially aligned with one end of the rod; and
(c) means for providing greater than about 40 percent air dilution to the cigarette; the cigarette further comprising
(d) nicotine levulinate as an additive thereto.

31. A cigarette comprising:

(a) a rod of smokable material contained in a circumscribing wrapping material, wherein
  (i) at least about 70 percent by weight of the smokable material is flue-cured tobacco material;
  (ii) the wrapping material is a paper wrap containing inorganic oxide and/or inorganic hydroxide, has an inherent permeability of less than about 45 CORESTA units, and has a net permeability of greater than 50 CORESTA units; and
  (iii) the packing density of the smokable material within the rod is between about 100 mg/cm$^3$ and about 250 mg/cm$^3$;
(b) mouthend piece axially aligned with one end of the rod; and (c) means for providing greater than about 30 percent air dilution to the cigarette; the cigarette further comprising (d) levulinic acid as an additive thereto.

32. The cigarette of claim 31 further comprising nicotine as an additive thereto.

33. The cigarette of claim 30, 31 or 32 wherein the mouthend piece is a filter element which is capable of providing about 40 weight percent or less mainstream tobacco smoke particulate removal efficiency.

34. A cigarette comprising:

(a) a rod of smokable material contained in a circumscribing wrapping material; wherein (i) the rod has a circumference of about 21 mm or less, (ii) the wrapping material is a paper wrap, has an inherent permeability of less than 45 CORESTA units, and has a net permeability of greater than about 50 CORESTA units, and (iii) the packing density of the smokable material within the rod is between about 100 mg/cm$^3$ and about 200 mg/cm$^3$; and (b) filter means axially aligned with one end of the rod, and which is capable of providing about 40 weight percent or less mainstream smoke particulate removal efficiency; the cigarette further comprising (c) nicotine levulinate as an additive thereto.

35. A cigarette comprising:

(a) a rod of smokable material contained in a circumscribing wrapping material; wherein (i) the rod has a circumference of about 21 mm or less, (ii) the wrapping material is a paper wrap, has an inherent permeability of less than 45 CORESTA units, and has a net permeability of greater than about 50 CORESTA units, and (iii) the packing density of the smokable material within the rod is between about 100 mg/cm$^3$ and about the rod is between about 100 mg/cm$^3$ and about 200 mg/cm$^3$; and (b) filter means axially aligned with one end of the rod, and which is capable of providing about 40 weight percent or less mainstream smoke particulate removal efficiency; the cigarette further comprising (c) levulinic acid as an additive thereto.

36. The cigarette of claim 35 further comprising nicotine as an additive thereto.

37. The cigarette of claim 34, 35 or 36 further comprising means for providing air dilution thereto.

38. The cigarette of claim 34, 35 or 36 further comprising means for providing greater than about 30 percent air dilution thereto.

39. The cigarette of claim 34, 35 or 36 wherein the wrapping material is a paper wrap containing magnesium oxide and/or magnesium hydroxide.

40. The cigarette of claim 34, 35 or 36 wherein the wrapping material is electrostatically perforated so as to have an inherent permeability of less than about 15 CORESTA units, and a net permeability of greater than about 80 CORESTA units.

41. A cigarette comprising:

(a) a rod of smokable material contained in a circumscribing wrapping material, wherein (i) the wrapping material is a paper wrap containing inorganic oxide and/or inorganic hydroxide, has an inherent permeability of less than a45 CORESTA units, and has a net permeability of greater than 50 CORESTA units; and (ii) the packing density of the smokable material is between about 100 mg/cm$^3$ and about 250 mg/cm$^3$; and (b) mouthend piece axially aligned with one end of the rod; and (c) means for providing greater than about 40 percent air dilution to the cigarette; the cigarette further comprising (d) nicotine levulinate as an additive thereto.

42. A cigarette comprising:

(a) a rod of smokable material contained in a circumscribing wrapping material, wherein (i) the wrapping material is a paper wrap containing inorganic oxide and/or inorganic hydroxide, has an inherent permeability of less than 45 CORESTA units, and has a net permeability of greater than 50 CORESTA units; and (ii) the packing density of the smokable material is between about 100 mg/cm$^3$ and about 250 mg/cm$^3$; and (b) mouthend piece axially aligned with one end of the rod; and (c) means for providing greater than about 40 percent air dilution to the cigarette; the cigarette further comprising (d) levulinic acid as an additive thereto.

43. The cigarette of claim 42 further comprising nicotine as an additive thereto.

44. The cigarette of claim 41, 42 or 43 wherein (i) the mouthend piece is a filter element which is capable of providing about 40 weight percent or less mainstream tobacco smoke particulate removal efficiency, and (ii) the wrapping material is a paper wrap containing magnesium oxide and/or magnesium hydroxide.

45. The cigarette of claim 1 or 2 wherein at least about 70 percent by weight of the smokable material is flue-cured tobacco material.

* * * * *